US010595614B2

(12) United States Patent
Benigni et al.

(10) Patent No.: US 10,595,614 B2
(45) Date of Patent: Mar. 24, 2020

(54) DEVICE FOR DISPENSING A PRODUCT

(71) Applicant: QUALIPAC, Clichy (FR)

(72) Inventors: Christophe Benigni, Pantin (FR); Frédéric Jouan, Moriers (FR); Gérald Martines, Paris (FR)

(73) Assignee: QUALIPAC, Clichy (FR)

( * ) Notice: Subject to any disclaimer, the term of this patent is extended or adjusted under 35 U.S.C. 154(b) by 0 days.

(21) Appl. No.: 16/084,312

(22) PCT Filed: Sep. 27, 2017

(86) PCT No.: PCT/FR2017/052626
§ 371 (c)(1),
(2) Date: Dec. 3, 2018

(87) PCT Pub. No.: WO2018/078231
PCT Pub. Date: May 3, 2018

(65) Prior Publication Data

US 2019/0082809 A1 Mar. 21, 2019

(30) Foreign Application Priority Data

Oct. 27, 2016 (FR) ..... 16 60424

(51) Int. Cl.
*A45D 40/06* (2006.01)

(52) U.S. Cl.
CPC ..... *A45D 40/06* (2013.01)

(58) Field of Classification Search
CPC ..... A45D 40/04; A45D 40/06; A45D 40/12; A45D 2040/208
See application file for complete search history.

(56) References Cited

U.S. PATENT DOCUMENTS

| | | | | |
|---|---|---|---|---|
| 4,812,066 A * | 3/1989 | Gueret | A45D 40/06 401/78 |
| 5,143,464 A | 9/1992 | Susini et al. | |
| 6,200,049 B1 * | 3/2001 | Pinhel | A45D 40/06 401/63 |
| 6,244,770 B1 | 6/2001 | Holloway | |

(Continued)

FOREIGN PATENT DOCUMENTS

| | | |
|---|---|---|
| CN | 205 568 180 U | 9/2016 |
| EP | 0 461 001 B1 | 7/1994 |
| EP | 0 719 510 A1 | 7/1996 |

(Continued)

*Primary Examiner* — David P Angwin
*Assistant Examiner* — Bradley S Oliver
(74) *Attorney, Agent, or Firm* — Im IP Law; Chai Im; C. Andrew Im

(57) ABSTRACT

A device to distribute a product which includes a sheath, a cup and a spiral body having at least one helical groove for guiding. The sheath is rotatable with respect to the spiral body and fitted into the spiral body. The sheath includes at least one opening having at least two portions non-parallel to the generatrix of the inner cylinder of the sheath and forming between them an obtuse angle strictly less than one hundred eighty degrees. The cup includes at least one guiding pin inserted into the helical guiding groove and into the opening. The guiding pin being displaced simultaneously along the helical groove and the opening when the sheath is set into rotation with respect to the spiral body.

7 Claims, 5 Drawing Sheets

(56) References Cited

U.S. PATENT DOCUMENTS 9,004,793 B2 * 4/2015 Huang ..... A45D 40/12
401/71

FOREIGN PATENT DOCUMENTS

| | | | |
|---|---|---|---|
| EP | 0 799 589 | A2 | 10/1997 |
| FR | 2 889 922 | A1 | 3/2007 |
| JP | S63 15916 | U | 2/1988 |
| JP | H02 71420 | U | 5/1990 |

* cited by examiner

DEVICE FOR DISPENSING A PRODUCT

RELATED APPLICATIONS

This application is a § 371 application from PCT/FR2017/052626 filed Sept. 27, 2017, which claims priority from French Patent Application No. 16 60424 filed Oct. 27, 2016, each of which is herein incorporated by reference in its entirety.

FIELD OF THE INVENTION

This invention relates to a device for the distribution of a product.

This invention applies to the field of containers of products wherein the product or the distribution system can be retracted at least partially inside the device.

More particularly, this invention applies to the field of devices comprising a rigid cosmetic product having the form of a cake, such as for example a cake of lipstick, a lip balm, a stick of eye shadow, khol, foundation, corrector, deodorant or other cosmetic products, the cake of product able to be retracted into the device. This invention also applies to the field of makeup brushes of which the bristles can be retracted and to the field of systems for distributing perfume or a care product of which the diffuser is telescopic.

BACKGROUND OF THE INVENTION

Retractable devices, objects of the invention, are found mostly in the field of lipsticks, so the description of the advantages of the invention in relation to the state of the art shall be given for lipsticks, with the understanding that this application is solely indicative and not limiting.

Retractable devices must allow a product to be taken out of a protective device in order to be used, then retracted after use in order to return to a storage position wherein they are protected. As the product is used in the extended position, the device must be able to support an axial force that authorises the application of the product, without the latter retracting spontaneously, such an effect is called anti-push back.

In addition, the user of the product must feel a certain comfort during the extracting and retracting of the product and the product must optionally be easy to adjust—this is in particular the case with lipsticks for which the user be easily be able to adjust the level of extension of the product allowing for precise and comfortable application, and this as the cake of makeup product is progressively used.

U.S. Pat. No. 6,244,770 B1 discloses a lipstick container comprising a case comprising a spiral, a sheath and a cup comprising a pin, the pin being displaced in a longitudinal sheath window and the pin comprising a flat spot increasing the coefficient of friction between the spiral and the pin in the direction of retraction. The increase in the coefficient of friction allows the product to resist a more substantial push back force before being retracted. However, the force provided by the user to manoeuvre the device is also stronger which decreases the comfort of use for the user.

European Patent No. EP 0461001 B1 discloses a lipstick container comprising a case comprising a spiral, a sheath and a cup comprising a pin, the pin being displaced in a longitudinal sheath window and the pin comprising a shoulder allowing for a blocking of the pin at the beginning and at the end of the stroke.

Such a device allows the product to resist a large force in the totally extended and totally retracted positions, however a small rotation of the cup in relation to the sheath unlocks the cup and the product is retracted therefore entirely without great resistance to the push back, yet the application of the product typically takes place in a position that is partially extended from the device, even though this position has a mediocre resistance to the push back.

European patent application No. EP 0799589 A1 discloses a lipstick container comprising a case comprising a spiral, a sheath and a cup comprising a pin, the pin being displaced in a longitudinal sheath window and the pin comprising a particular form in such a way as to increase the coefficient of friction between the spiral and the pin in the direction of retraction of the product. The device disclosed in said patent application makes it possible to increase the force beyond which the product is retracted. However, the force is also more substantial when the user wants to retract the product.

All of the aforementioned documents disclose means for modulating the coefficient of friction between the cup, the sheath and the spiral. However, in all of these devices the coefficient of friction is determined by design and is uniform for a given device all throughout the stroke of the cup. None of the aforementioned documents of prior art disclose a container that makes it possible to modulate the displacement speed or the coefficient of friction of the cup according to the position of the cup in the sheath.

OBJECT OF THE INVENTION

This invention aims to overcome all or a portion of these disadvantages. In particular, this invention makes it possible to have a great resistance to the push back while still offering users a comfort and precision in the use of the product that is improved. This invention also makes it possible to module the displacement speed and the friction torque of the cup, integral in translation with the cake of the product, according to the position of the cup in the sheath.

To this effect, according to a first aspect, this invention relates to a device for the distribution of a product characterised in that it comprises:

- a spiral body comprising at least one helical guiding groove,
- a sheath:
  - rotatable with respect to the spiral body,
  - fitted into the spiral body and
  - comprising at least one opening comprising at least two portions non-parallel to the generatrix of the inner cylinder of the sheath and forming between them an obtuse angle strictly less than one hundred eighty degrees; and
- a cup comprising at least one guiding pin inserted into the helical guiding groove and into the opening, and being displaced simultaneously along the helical groove and the opening when the sheath is set into rotation with respect to the spiral body.

In other terms, the opening comprising two ends and a central portion which is not straight.

The term main axis of the device designates a central axis passing through the device object of the invention in its greatest length. The main axis is parallel to the generatrices of the sheath.

Thanks to these arrangements, and if a constant speed of rotation is considered of the sheath in relation with the spiral body, the displacement speed in translation of the cup in the sheath is modulated by the position of the cup in the sheath.

Advantageously, a form comprising an angle and comparable to that of a boomerang, oriented with respect to the slope of the spiral in such a way that the angle formed between the lower portion of the window and the spiral is more closed than the angle formed between the upper portion of the window and the spiral, makes it possible to adopt a rapid speed in a first portion of the trajectory of the cup in the sheath from the entirely retracted storage position, and a reduced speed in a second portion of the trajectory.

This combination is favourable in that during the typical use of such a cosmetic product the application takes place when the cup is in a partially extended position which guarantees a certain distance between the upper edge of the tube and the end of the cake of the product which forms the application zone of the product. Therefore the stroke of the cup, integral in translation with the cake of the product, is comprised of two portions with substantially different functions:

- the first portion of the stroke, from the entirely retracted storage position is intended to expose the useful portion of the cake of the product, it is advantageous that this initial stroke be travelled quickly;
- the second portion of the stroke is intended to finely adjust the quantity of the product exposed in order to allow for a precise and comfortable application, this portion of the stroke must also allow for a fine adjusting of the extended position in order to compensate for the progressive wear of the cake of the product during the repeated use thereof—it is advantageous here that this stroke be travelled relatively slowly in order to favour the precision of the adjustment of the height extended.

In addition, the coefficient of friction between the sheath and the pin of the cup is linked to the local value of the angle between the spiral and the window. The change in orientation of the window along the stroke of the cup results as such by a change in the coefficient of friction. In the example hereinabove, when the sheath is set into rotation with respect to the spiral, the coefficient of friction is relatively high when the cup is located in the bottom portion of its stroke (position close to the retracted position—relatively closed angle between the spiral and the opening) and lower when the cup is located in the top portion of its stroke (position close to the extended position—relatively open angle between the spiral and the opening).

This disposition favours the adjusting precision of the extended height intended for the application of the product.

Inversely, still in the example hereinabove, when the cup is stressed by an axial force the coefficient of friction is higher in the top part of the stroke, generating a push back force that is relatively high. Yet this position is the preferred position of use, as such this relatively high value of the coefficient of friction prevents an untimely retraction of the product during application, as such improving the resistance to the push back.

In the devices for which the sheath comprises a straight vertical opening described in prior art it is usual for those skilled in the art to seek via construction a friction torque that is sufficiently high to prevent the untimely retraction of the product during use, but this imposes an operation that is considered to be 'hard' and not very comfortable by the users, and does not allow for a fin adjusting of the extended position in order to optimise the application precision.

As such, in summary, the advantages of the invention are to combine:

- an optimum usage comfort because the device does not require an excessively high coefficient of friction by construction,
- an optimum application precision by allowing for the fine adjusting of the extended position of the device all throughout its duration of use and of the progressive wear of the cake of the product and
- the absence of untimely retraction of the product during application.

In certain embodiments, at least one end of at least one opening of the sheath comprises an angle strictly between zero degrees and one hundred eighty degrees with respect to the adjacent portion of the opening.

The advantage of these embodiments is to create at the ends a bearing surface of the pin of the cup on the sheath perpendicular to the axial stresses of the cup allowing for a blocking in the entirely retracted or entirely extended position of the cup:

- a blocking in the entirely extended position of the cup is useful in allowing for the conditioning of the device, operation during which a relatively rigid cosmetic product is introduced by force into the cup—it is important that the cup does not untimely retract during this operation;
- a blocking in the entirely retracted position of the cup is useful as a storage position of the device during its residence time in the supply chain and between two uses of the product by its user—it is important in these circumstances that the impacts and vibrations of the transport do not create an untimely partial extending of the cup, which would result in damaging the end of the cake of the product via contact with the bottom of the cap that typically covers the device.

In certain embodiments, the sheath comprises, furthermore, flexible friction means between the sheath and the spiral body.

The advantage of these embodiments is to provide a controlled friction between the sheath and the spiral in order to guarantee a coefficient of friction which provides comfort for the user and in order to prevent a possible undesired extending of the product.

In certain embodiments, the cup comprises, furthermore, flexible friction means between the cup and the sheath.

The advantage of these embodiments is to provide a controlled friction between the cup and the sheath in order to guarantee a coefficient of friction which provides comfort for the user and in order to prevent a possible undesired extending of the product.

The flexible friction means integrated into the sheath and/or into the cup can be used separately or jointly. Advantageously, the device can be designed at the origin with flexible friction means integrated into the sheath and which rub against the spiral, these means being sized in order to provide the standard minimum friction torque of the device. By adding according to need additional friction means on the cup it will be possible to easily adapt the friction torque to the desired value for a given application, without needing to modify the friction means integrated into the sheath.

Indeed, it is customary in the profession of cosmetic packaging that each brand requests a cup form that is proper to it and suited to its preferences in terms of the conditioning method. As such it is customary that a specific cup mould be carried out for each brand. It is however advantageous that the other components of the mechanism, in particular the sheath and the spiral, be standard for a given manufacturer, so as to minimise the amount of investments by mutualising the moulds for the sheath and spiral for several uses and/or brands.

The advantage of being able to have additional friction means on the cup is to be able to propose at least cost an adaptation of the value of the coefficient of friction to each brand and/or use, these means being integrated into the specific mould of the cup without it being necessary to modify the sheath mould at each use.

In certain embodiments, a form of at least one end of the opening of the sheath corresponds to the form of the pin and comprises a relief for maintaining in position. This protruding relief positioned at the entrance of the horizontal portion of the opening, producing a local narrowing of the section of the window; this narrowing allows for a maintaining in position of the pin of the cup in the entirely retracted or entirely extended position; it also provokes a braking during the passing of the pin, requiring that the user exert a slightly more substantial force in order to cross this narrowing.

The advantage of these embodiments, in addition to maintaining the pin of the cup in the entirely retracted or entirely extended position, as such preventing an undesired displacement of the cup, is to create a specific audible signal when the cup comprising the product is entirely retracted or entirely extended; this audible signal is accompanied by a specific tactile feeling of a hard spot. This device acts as an audible and tactile control of the complete extension or retracting of the device.

In certain embodiments, a dimension of a form of at least one end of the opening of the sheath decreases progressively.

These embodiments have the advantage of remaining silent when the cup comprising the product is entirely retracted or entirely extended.

BRIEF DESCRIPTION OF THE FIGURES

Other advantages, purposes and particular characteristics of the invention shall appear in the non-limiting description that follows of at least one particular embodiment of a device for distributing a product, with regards to the accompanying drawings, wherein.

DESCRIPTION OF EMBODIMENTS OF THE INVENTION

Note that the figures are not to scale.

This description is given in a non-limiting manner, each characteristic of an embodiment able to be combined with any other characteristic of any other embodiment advantageously.

Figure 1:
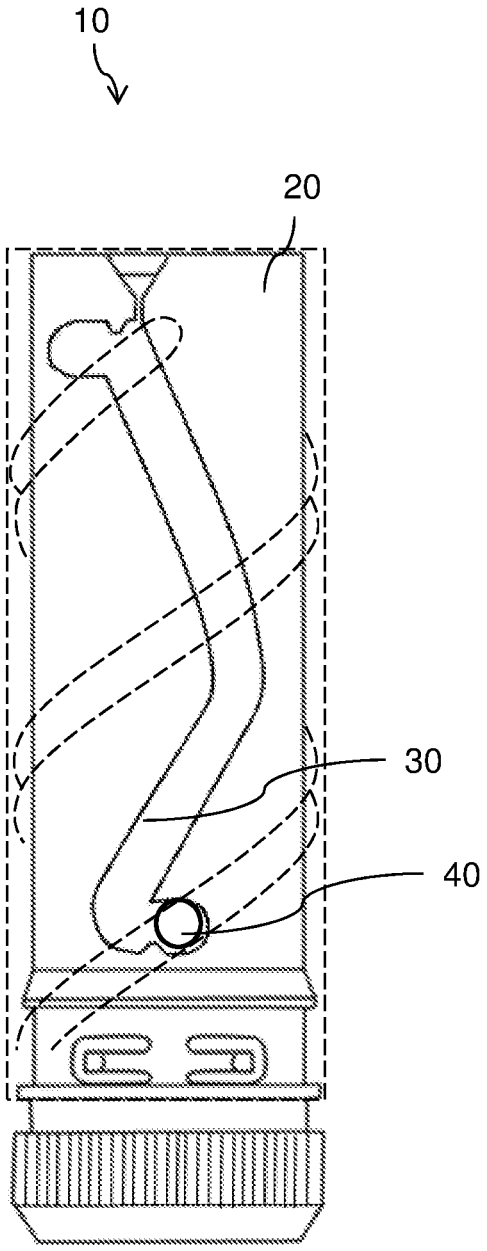
FIG. 1 shows, diagrammatically and as a plan, a first particular embodiment of a device object of this invention.

FIG. 1 shows a particular embodiment 10 of a device object of this invention.

The device 10 for the distribution of a product, such as a cake of lipstick for example, comprises:

- a spiral body 50 comprising at least one helical guiding groove, 515*a* or 515*b*,
- a sheath 20:
  - rotatable with respect to the spiral body 50,
  - fitted into the spiral body 50 and
  - comprising at least one opening, 200*a* or 200*b*, comprising two ends, 225 and 230, and a central portion 205, between the two ends, 225 and 230, of which the form comprises an angle, 220 and
- a cup 30 comprising at least one guiding pin 40 inserted into the helical guiding groove, 515*a* or 515*b*, and into the opening, 200*a* or 200*b*, and being displaced simultaneously along the helical groove, 515*a* or 515*b*, and the opening, 200*a* or 200*b*, when the sheath 20 is set into rotation with respect to the spiral body 50.

Figure 2:
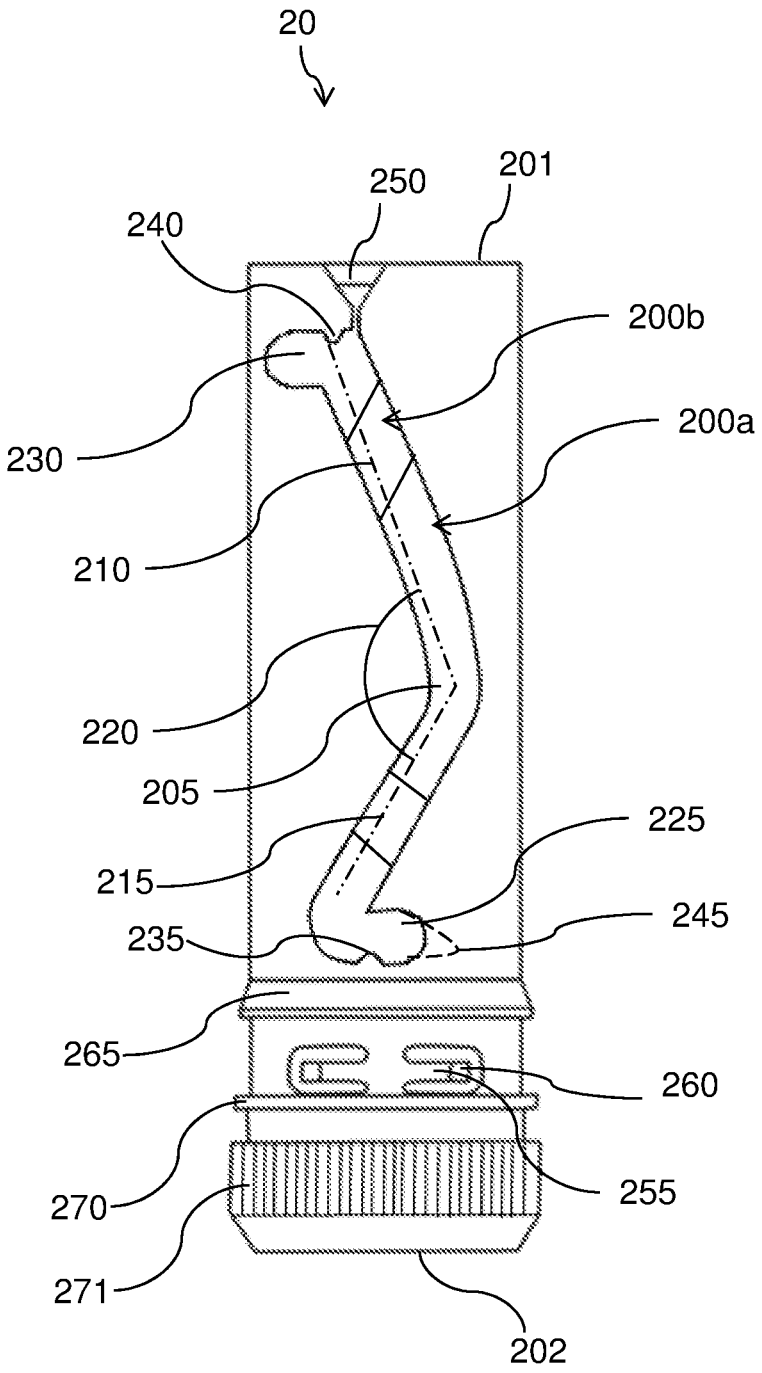
FIG. 2 shows, diagrammatically and as a plan, a first embodiment of a sheath of a device object of this invention.

FIG. 2 shows a particular embodiment of a sheath 20 of a device 10 object of this invention.

The sheath 20 is rotatable with respect to the spiral body 50 and fitted into the spiral body 50. The sheath 20 comprises at least one opening, 200*a* or 200*b*, comprising two ends, 225 and 230, and a central portion 205, between the two ends, 225 and 230, of which the form comprises an angle, 220.

The sheath 20 is preferably substantially a truncated cylinder comprising a shoulder 271 that defines a grasping zone of the sheath 20. Recall that a cylinder is a surface in space defined by a straight line, called generatrix, passing through a variable point describing a closed flat curve, called a director curve, and maintaining a fixed direction.

The sheath 20 is defined by an outer cylinder defining the outer casing of the sheath 20 and by an inner cylinder defining a partially blind opening in the sheath 20. The director curve of the inner cylinder is never secant with the director curve of the outer cylinder. Preferably, the director curve of the inner cylinder is parallel to the director curve of the outer cylinder so that the quantity of material forming the sheath 20 is of a constant thickness.

Preferably, the director curve of the outer cylinder of the sheath 20 is a circle and the director curve of the inner cylinder of the sheath 20 is a circle concentric to the circle, director curve, of the outer cylinder of the sheath 20.

Two faces, defining the truncated cylinder of the sheath 20, are in planes parallel to each other and perpendicular to the generatrix of the outer cylinder or of the inner cylinder of the sheath 20. A face referred to as "lower face" and a face referred to as "upper face" of the sheath 20 are defined here.

The upper face 201 comprises an orifice of which the form is the form of the director curve of the inner cylinder of the sheath 20. The lower face 202 is partially closed by the grasping zone of the sheath 20. The grasping zone of the sheath 20 is preferably a truncated cylinder of which the director curve is a circle. The diameter of the circle is greater than the diameter of the outer cylinder of the sheath 20, the centre of the circle is concentric with the centre of the circle of the outer cylinder and of the outer cylinder of the sheath 20. The generatrix of the grasping zone is parallel to the generatrix of the outer cylinder and of the inner cylinder.

The junction between the lower face 202 of the sheath 20 and the grasping zone of the sheath 20 preferably comprises a chamfer or a rounded portion in order to facilitate the insertion of the assembled device into the casing. The grasping zone of the sheath 20 can comprise reliefs for retaining and/or orientation, such as grooves, pins or flat spots.

The sheath 20 comprises a nesting relief 265 corresponding to a nesting relief 525 of the spiral body 50. The nesting relief 265 is closer to the lower face 202 than the opening, 200*a* or 200*b*. The nesting relief 265 is preferably a protruding relief on the outer cylinder of the sheath 20. The nesting relief 265 is such that, as a cross-section, the relief forms a triangle rectangle, the rectangle angle being the closest angle to the lower face 202 of the sheath 20.

The sheath 20 can comprise a collar 270 against which the spiral body 50 bears after nesting with the sheath 20 by means of the nesting relief 265.

The sheath 20 comprises at least one opening, 200*a* or 200*b*. Preferably, the sheath 20 comprises two openings, 200*a* and 200*b*, of the same form in axial symmetry in relation to one another along an axis parallel to the generatrix of the inner cylinder or of the outer cylinder passing through the centre of the director curve of the outer cylinder or of the inner cylinder which is a circle.

Hereinafter only one opening 200*a* is described, the opening 200*b* comprising the same essential characteristics.

The opening 200*a* comprises a central portion, 205. Two axes 210 and 215, according to which the central portion 205 is oriented, form an angle 220. The axis 210 defines the orientation of the portion referred to as "upper portion" of the opening. The upper portion is the closest portion to the upper face 201 of the sheath before the end 230. The axis 215 defines the orientation of the portion referred to as "lower portion" of the opening. The lower portion is the closest portion to the lower face of the sheath before the end 225. At least one of the two axes 210, 215 is oriented according to a non-zero angle with respect to a straight line parallel to the generatrix curve of the outer cylinder or of the inner cylinder.

Preferably, the two axes 210 and 215 are non-parallel to the generatrix of the inner cylinder and to the generatrix of the inner cylinder of the sheath 20. The axes 210 and 215 form an obtuse angle 220 and strictly less than one hundred eighty degrees. In certain embodiments, one of the axes, 210 or 215, is parallel to the generatrix of the inner cylinder or of the outer cylinder of the sheath 20.

The angle 220 between the axes 210 and 215 preferably corresponds to a rounded transition between the upper and lower portions of the opening 205.

The ends, 225 and 230, of the opening, 200*a* or 200*b*, have an axis that is substantially parallel to the upper face 201 and to the lower face of the sheath 20 and form an angle with the axes 210 and 215 of the central portion of the opening 200*a* or 200*b*. In certain embodiments, the axis 215 forms an acute angle with the end 225 and the axis 210 forms an obtuse angle with the end 230. These embodiments make it possible to have a higher speed at the beginning of the extending of the cup 30 than at the end of the extending of the cup 30. In other embodiments, the axis 210 forms an acute angle with the end 230 and the axis 215 forms an obtuse angle with the end 225. These embodiments make it possible to have a speed that is not as high at the beginning of the extending of the cup 30 than at the end of the extending of the cup 30.

The axis of the end 225 is substantially parallel to the lower face of the sheath 20 in order to block the pin 40. The end 225 is terminated by a rounded wall, of a form corresponding to the form of the pin 40. In embodiments, the end 225 is terminated by a wall 245 of which a dimension decreases progressively.

Preferably, the end 225 comprises a relief for maintaining in position 235 protruding in the end 225 in order to prevent a displacement of the pin 40 and therefore of the cup 30 in case of undesired rotation of the sheath 20 in relation to the spiral body 50. This relief can be arranged on one or the other of the edges of the end 225.

The axis of the end 230 is substantially parallel to the upper face 201 of the sheath 20 in order to block the pin 40 and prevent the pin from being displaced in the sheath 20 under an axial force. The end 230 is terminated by a rounded wall, of a form corresponding to the form of the pin 40. In certain embodiments, the end 230 is terminated by a wall of which a dimension decreases progressively.

Preferably, the end 230 comprises a relief for maintaining in position 240 protruding in the end 230 in order to prevent a displacement of the pin 40 and therefore of the cup 30 in case of a substantial force along an axis parallel to the generatrix curve of the inner or outer cylinder on the cup 30. This relief can be arranged on one or the other of the edges of the end 230.

The sheath 20 can comprise an access 250 connecting the opening 205 to the upper face 201 of the sheath 20. The access allows for an elastic deformation of the opening in order to insert the pin 40 into the opening during the mounting of the device 10. The access is an opening of decreasing dimensions in the form of a bottleneck, such as a triangle of which one of the faces coincides with the upper face 201 of the sheath 20. The pin 40 is easily inserted into the opening but an extending of the pin 40 is impossible under a normal force of use of the device 10.

In certain embodiments, a single opening, 200*a* or 200*b*, comprises at least one relief, 235 or 240, for maintaining in position. The ends of the openings, 200*a* or 200*b*, can be different.

The sheath 20 can comprise flexible friction means 255 between the sheath 20 and the spiral body 50. The flexible means 255 can be substantially rectangular slats cut out on three faces in the sheath 20, close to the grasping zone of the sheath 20. The slats comprise a relief 260 that is protruding pressing on the spiral body 50. The form of the relief 260, and the materials of the sheath 20 and of the spiral body 50 define the coefficient of friction between the sheath 20 and the spiral body 50.

So that the flexible means 255 retain their elastic properties all throughout the life of the device, without conforming under stress, it is important to choose for the sheath a polymer having good shape memory characteristics, such as for example, Polyoxymethylene, Polybutylene terephthalate, Polycarbonate or copolyesters (non-exhaustive list).

Figure 3:
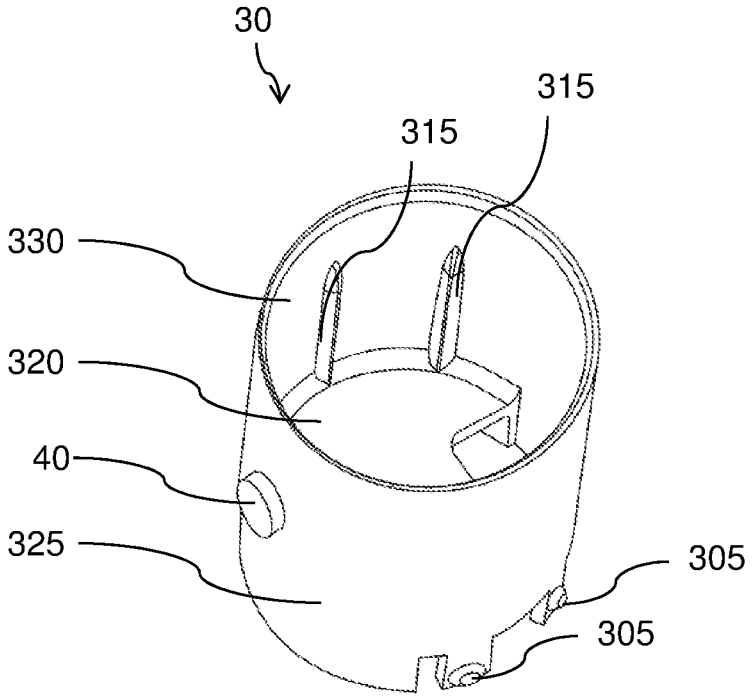
FIG. 3 shows, diagrammatically and in perspective, a first particular embodiment of a cup of a device object of this invention.

FIG. 3 shows a particular embodiment of a cup 30 of a device 10 object of this invention.

The cup 30 comprises at least one guiding pin 40 inserted into a helical guiding groove, 515*a* or 515*b*, and into an opening, 200*a* or 200*b*, of the sheath 20 and being displaced simultaneously along the helical groove, 515*a* or 515*b*, and the opening, 200*a* or 200*b*, when the sheath 20 is set into rotation with respect to the spiral body 50.

The cup 30 is preferably substantially a truncated cylinder. The cup 30 is defined by an outer cylinder 325 defining the outer casing of the cup 30 and par an inner cylinder 330 defining the inner casing of the cup 30. The director curve of the inner cylinder 330 is never secant with the director curve of the outer cylinder 325. Preferably, the director curve of the inner cylinder 330 is parallel to the director curve of the outer cylinder 325 so that the quantity of material forming the cup 30 is of a constant thickness.

Preferably, the director curve of the outer cylinder 325 of the cup 30 is a circle and the director curve of the inner cylinder 330 of the cup 30 is a circle concentric to the circle, director curve, of the outer cylinder 325 of the cup 30.

Two faces defining the truncated cylinder of the cup 30 are in planes parallel to each other and perpendicular to the generatrix of the outer cylinder 325 or of the inner cylinder 330 of the cup 30. A face referred to as the "lower face" and a face referred to as the "upper face" of the cup 30 are defined here.

The lower face and the upper face comprise an orifice of which the form is the form of the director curve of the inner cylinder 330 of the cup 30. The one at least of the orifices of the lower face and of the upper face of the cup is at least partially blind, a wall of material closing at least partially one of the two orifices in the truncated cylinder of the cup 30. The truncated cylinder of the cup 30 is defined by two faces parallel to each other and perpendicular to the generatrix of the outer cylinder 325 or of the inner cylinder 330.

The wall closing at least partially one of the two orifices in the truncated cylinder of the cup 30 comprises a face 320 against which the cake of the product abuts, for example the cake of lipstick, during the conditioning. Reliefs 315 for retaining the cake of the product are located on the face 320 and on the inner cylinder 330 of the cup 30. The reliefs for retaining the cake 315 can have a substantially pyramidal shape, with a base comprising three faces and of which the edges are rounded. The reliefs for retaining the cake 315 have a dimension according to the outer cylinder 325 that is greater than the dimensions according to the face 320. Other forms of reliefs for retaining are possible. The reliefs for retaining the cake 315, by provoking a local deformation of the cake of the product during the insertion thereof by force into the cup, provides a maintaining in traction of the cake of the product and prevent the cake from being displaced in rotation in the cup 30. The reliefs for retaining the cake 315 can be distributed regularly over the face 320.

The junction between the face 320 and the inner cylinder 330 of the cup 30 is preferably chamfered or rounded.

The outer cylinder 325 of the cup 30 comprises at least one pin 40. Preferably, the cup 30 comprises as many pins 40 as the sheath 20 comprises openings. In preferred embodiments, the cup 30 comprises two pins 40 and the sheath 20 comprises two openings, 200 and 200*b*. The pins 40 are of similar shape and characteristics and diametrically opposite according to an axis passing through the centre of the circle, director curve, of the inner cylinder 330 or of the outer cylinder 325 and parallel to the generatrix curve of the inner cylinder 330 or of the outer cylinder 325.

The outer cylinder 325 can comprise flexible friction means 305 between the cup 30 and the sheath 20. The flexible means 305 can be substantially rectangular slats cut out on three faces in the cup 30, close to the lower face of the cup 30 or opening onto the lower face of the cup 30. The slats comprise a relief that is protruding pressing on the inner cylinder of the sheath 20. The form of the relief, and the materials of the sheath 20 and of the reliefs 305 define the coefficient of friction between the cup 30 and the sheath 20. Preferably, the relief is of a substantially spherical shape.

So that the flexible means 305 retain their elastic properties all throughout the life of the device, without conforming under stress, it is important to choose for the cup a polymer having good shape memory characteristics, such as for example, Polyoxymethylene, Polybutylene terephthalate, Polycarbonate or copolyesters (non-exhaustive list).

The dimensions of the outer cylinder of the cup 30 are less than the dimensions of the inner cylinder of the sheath 20. The cup 30 can therefore be inserted into the inner cylinder of the sheath 20.

Figure 4:
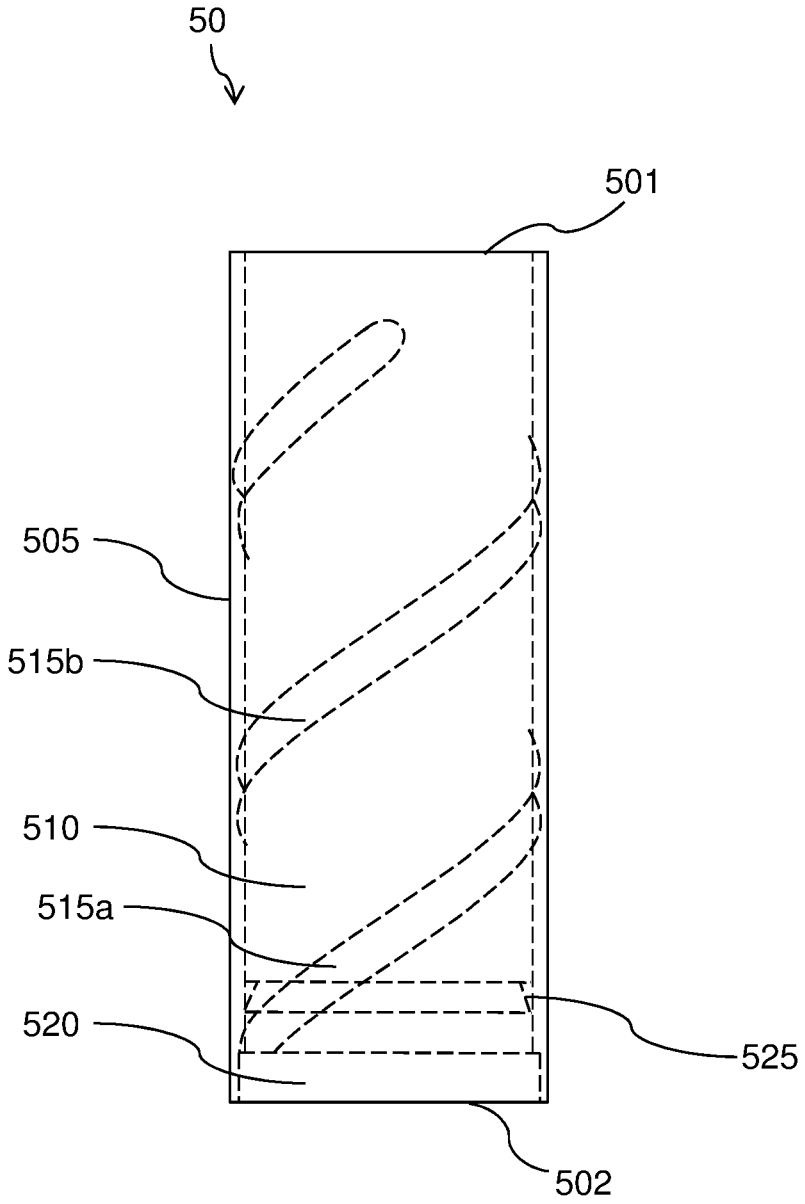
FIG. 4 shows diagrammatically and as a plan, a first particular embodiment of a spiral body object of this invention

FIG. 4 shows a particular embodiment of a spiral body 50 of a device 10 object of this invention.

The spiral body 50 comprises at least one helical groove, 515*a* or 515*b*.

The spiral body 50 is preferably substantially a truncated cylinder. The spiral body 50 is defined by an outer cylinder 505 defining the outer casing of the spiral body and par an inner cylinder 510 defining the inner casing of the spiral body. The director curve of the inner cylinder 510 is never secant with the director curve of the outer cylinder 505. Preferably, the director curve of the inner cylinder 510 is parallel to the director curve of the outer cylinder 505 so that the quantity of material forming the spiral body is of a constant thickness.

Preferably, the director curve of the outer cylinder 505 of the spiral body is a circle and the director curve of the inner cylinder 510 of the spiral body is a circle concentric to the circle, director curve, of the outer cylinder 505 of the spiral body.

Two faces defining the truncated cylinder of the spiral body 50 are in planes parallel to each other and perpendicular to the generatrix of the outer cylinder 505 or of the inner cylinder 510 of the spiral body 50. A face referred to as "lower face" and a face referred to as "upper face" of the spiral body 50 are defined here.

The upper face 501 and the lower face comprise an orifice of which the form is the form of the director curve of the inner cylinder 510 of the spiral body 50.

The lower face 502 of the spiral body 50 comprises a shoulder 520 on the lateral wall on which the friction means 255 of the sheath 20 bear against, and wherein the pin 40 of the cup 30 is inserted during the assembly of the device 10. Each helical groove, 515*a* or 515*b*, opens onto the shoulder 520. Preferably, the spiral body 50 comprises as many helical grooves, 515*a* or 515*b*, as the sheath 20 comprises openings, 200*a* or 200*b*. In preferred embodiments, the spiral body 50 comprises two helical grooves, 515*a* and 515*b*, the sheath 20 comprises two openings, 200*a* and 200*b*. The helical grooves, 515*a* and 515*b*, are of similar shape and characteristics and diametrically opposite according to an axis passing through the centre of the circle, director curve, of the inner cylinder 510 or of the outer cylinder 505 and parallel to the generatrix curve of the inner cylinder 510 or of the outer cylinder 505.

The pitch of each helical groove, 515*a* or 515*b*, is equal to the length of the opening, 200*a* or 200*b*, measured along an axis parallel to the generatrix curve of the inner cylinder or of the outer cylinder of the sheath 20. When a pin 40 passes through the entire length of a helical groove, 515*a* or 515*b*, the pin 40 simultaneously travels the entire length of an opening, 200*a* or 200*b*, of the sheath 20.

The spiral body 50 can comprise a nesting relief 525 corresponding to a nesting relief 265 of the sheath 20. The nesting relief 525 is preferably interrupted at the location of the helical groove. The nesting relief 525 is preferably a protruding relief on the inner cylinder 510 of the spiral body 50. The nesting relief is such that, as a cross-section, the relief substantially forms a triangle rectangle, the rectangle angle being the closest angle to the upper face of the spiral body 50. During the nesting, the spiral body 50 and the sheath 20 are elastically deformed until the snap-fitting of the nesting reliefs 265 and 525.

The dimensions of the inner cylinder 510 of the spiral body 50 are greater than the dimensions of the outer cylinder of the sheath 20. The sheath 20 can therefore be inserted into the inner cylinder 510 of the spiral body 50.

In FIG. 1, the cup 30 is entirely retracted in the sheath 20. The relief 235 of the opening, 200*a* or 200*b*, for maintaining in position of the cup 30 is nested with the pin 40 of the cup 30.

Figure 5:
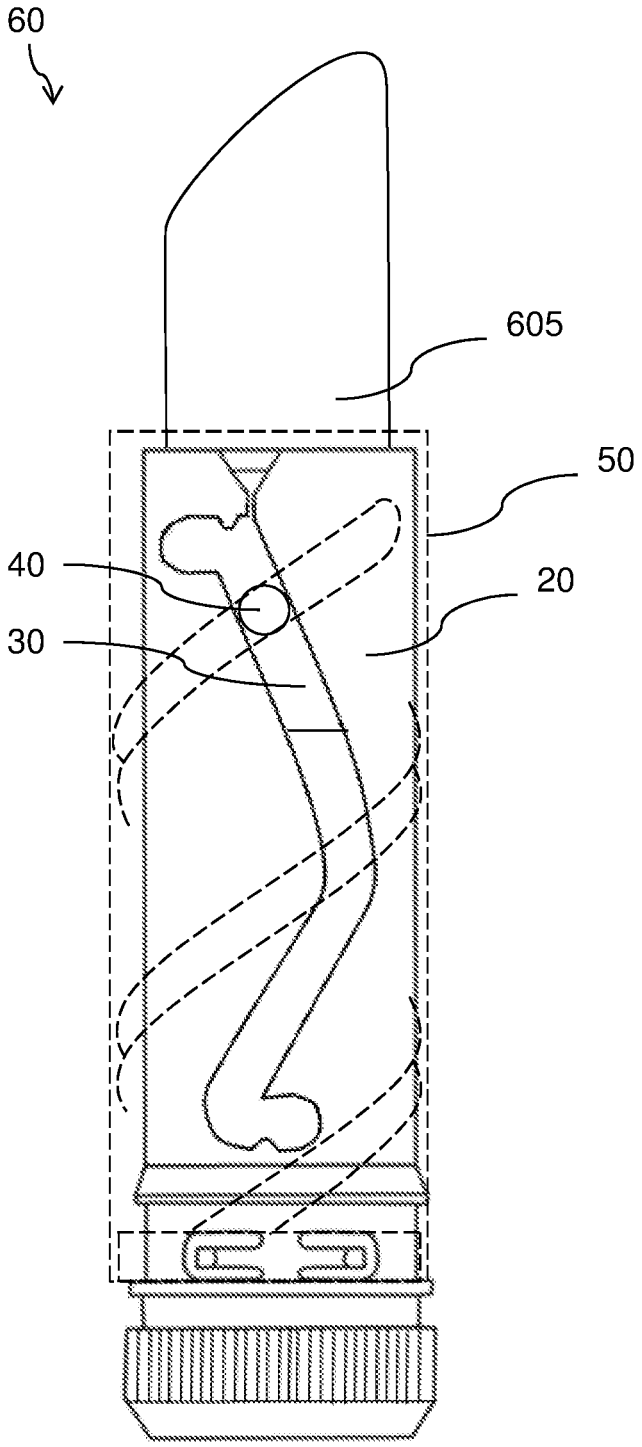
FIG. 5 shows diagrammatically and as a plan, a first particular embodiment of a device object of this invention in a different position.

FIG. 5 shows the device 10 wherein the cup 30 is in a partially retracted or partially extended position in the sheath 20. The pin 40 of the cup 30 is in the upper portion of the opening, 200*a* or 200*b*, of the sheath. A cake of lipstick 605 is placed in the cup 30 in the partially extended or partially retracted position.

In order to assemble the device 10, the pin 40 is placed above the access 250 of the opening, 200*a* or 200*b*, the cup 30 is therefore aligned with the sheath 20. Then a force is exerted on the cup 30, separating the walls from the access 250, by an elastic deformation, in order to have the pin 40 pass. Once the pin 40 has entirely passed into the access 250, the access 250 returns to its initial form. The cup 30 is put into the entirely retracted position. The relief 235 of the opening, 200*a* or 200*b*, for maintaining in position of the cup 30 is nested with the pin 40 of the cup 30.

The spiral body 50 is aligned with the sheath 20. The insertion of the spiral body 50 on the sheath 20 is done through the inserting of the upper face of the sheath 20 into the lower face of the spiral body 50. The helical groove, 515*a* or 515*b* is aligned with the pin 40. Then, through a movement of rotation, the spiral body 50 is displaced towards the lower face of the sheath 20 until nesting of the nesting relief 525 of the spiral body 50 with the nesting relief 265 of the sheath 20. For the nesting, the spiral body 50 and the sheath 20 can be deformed elastically.

A decorative body made of any material, metal, plastic, wood, carton, textile, etc. can then be mounted on the device 10 in order to reinforce its aesthetic aspect. The decorative body is made integral with the spiral 50 by gluing, snap-fitting, crimping, force-fitting or any suitable means, in such a way that a rotation exerted by the user on said decorative body is transmitted fully to the spiral 50 and as such allows for the actuating of the mechanism.

The decorative body can have any length in relation with the total height of the assembled device 10. The upper end of the decorative body can preferably coincide with the upper end of the spiral body 50. The lower end of the decorative body can extend axially downwards from the device 10 until any height. The outer grasping diameter of the sheath 20 is less than the outer diameter of the spiral body 50, in such a way that if the decorative body axially covers the grasping zone of the sheath 20 the device can freely operate in rotation. This characteristic is an original and inventive characteristic of the device 10 in relation to prior art. Indeed the use is that the grasping zone is of an outer diameter greater than that of the spiral body, which prevents the decorative body from covering the grasping zone of the sheath, which can present a disadvantage from an aesthetic standpoint in the case where for example the device 10 would be inserted into a transparent casing, thus leaving for view the grasping zone of the sheath, which is not very aesthetic.

In order to allow for the assembly of the device 10 provided with a decorative body covering the grasping zone of the sheath, secondary retaining details are arranged inside the base of the grasping zone, making it possible to assemble it to an outer casing provided with a central pin.

In normal use of the device 10, considering that the cup 30 is in the entirely retracted position, the spiral body 50 is set into rotation in relation to the sheath 20, possibly by the intermediary of a decorative body. The relief 235 for maintaining in position is unblocked and the pin 40 is set into motion in the lower portion of the opening, 200*a* or 200*b*. The pin 40 is simultaneously displaced along the helical groove, 515*a* or 515*b*, and the opening, 200*a* or 200*b*, when the sheath 20 is set into rotation with respect to the spiral body 50.

In the lower portion of the opening, 200*a* or 200*b*, the angle formed between the opening 200*a*, 200*b* with the spiral 515*a*, 515*b* is relatively closed, as such for a given value of rotation R of the spiral body, the pin 40 travels a vertical stroke C1 that is relatively substantial. The extraction speed of the cup 30 is therefore relatively high in this lower portion of its stroke.

On the contrary, once the pin 40 has exceeded the elbow 220 of the opening 200*a*, 200*b*, the angle formed between the opening 200*a*, 200*b* with the spiral 515*a*, 515*b* is relatively open, as such for the same given value of rotation R of the spiral body, the pin 40 travels a vertical stroke C2 that is relatively small. The extraction speed of the cup 30 is therefore relatively low in this upper portion of its stroke, providing the user with a fine adjustment of the exposed portion of the cake 605.

Once the pin 40 has reached the end 230 of the opening, 200*a* or 200*b*, it is caught in the relief 240 for maintaining in position.

A user can decide to partially extract the cup 30 and to use the device with the pin 40 located in the upper portion of its stroke. In this case, the relatively open angle formed between the opening 200*a*, 200*b* and the spiral 515*a*, 515*b* generates a high coefficient of friction between the cup, the sheath and the spiral and as such makes it possible to resist an axial push back force.

After use of the product distributed by the device 10, via a rotation in the opposite direction of the sheath 20 in relation to the spiral body 50, the cup 30 is entirely retracted. The pin 40 is simultaneously displaced along the helical groove, 515*a* or 515*b*, and the opening, 200*a* or 200*b*, when the sheath 20 is set into rotation with respect to the spiral body 50.

The invention claimed is:

1. A device to distribute a product, comprising:

a spiral body comprising at least one helical guiding groove;

a sheath rotatable with respect to the spiral body and fitted into the spiral body, the sheath comprising at least one opening comprising four portions: a lower end substantially parallel to a lower face of the sheath, an upper end substantially parallel to an upper face of the sheath, and a central portion comprising two portions: an upper portion and a lower portion;

the upper portion and the lower portion extending along two corresponding axes non-parallel to a generatrix of an inner cylinder of the sheath and forming an obtuse angle strictly less than one hundred eighty degrees between the upper portion and the lower portion; and a cup comprising at least one guiding pin inserted into said at least one helical guiding groove and into said at least one opening, said at least one guiding pin being displaced simultaneously along said at least one helical guiding groove and said at least one opening in response to a rotation of the sheath with respect to the spiral body.

2. The device according to claim 1, wherein at least one end of said at least one opening of the sheath comprises an angle strictly between zero and one hundred eighty degrees with respect to an adjacent portion of the opening.

3. The device according to claim 1, wherein at least one end of said at least one opening of the sheath comprises at least one relief to maintain said at least one guiding pin in position.

4. The device according to claim 1, wherein the sheath further comprises a flexible friction element between the sheath and the spiral body.

5. The device according to claim 1, wherein the cup further comprises a flexible friction element between the cup and the sheath.

6. The device according to claim 1, wherein a form of at least one end of said at least one opening of the sheath corresponds to a form of said at least one guiding pin.

7. The device according to claim 1, wherein a dimension of a form of at least one end of said at least one opening of the sheath decreases progressively.

* * * * *